United States Patent [19]

Horikawa et al.

[11] 4,226,563

[45] Oct. 7, 1980

[54] AUTOMATIC ARTICLE-LAYING APPARATUS

[75] Inventors: Kouetsu Horikawa; Kiyosuke Mori; Yukito Io, all of Kitakyushu, Japan

[73] Assignee: Nippon Steel Corporation, Tokyo, Japan

[21] Appl. No.: 10,980

[22] Filed: Feb. 9, 1979

[30] Foreign Application Priority Data

Feb. 16, 1978 [JP] Japan ..... 53-15928

[51] Int. Cl.[3] ..... E04G 21/14

[52] U.S. Cl. ..... 414/10; 52/747; 52/749

[58] Field of Search ..... 414/10, 87, 84; 52/747, 52/749; 266/281; 432/76

[56] References Cited

U.S. PATENT DOCUMENTS

| | | | |
|---|---|---|---|
| 3,298,154 | 1/1967 | Behr et al. | 52/749 |
| 3,601,245 | 8/1971 | Munroe | 414/10 |
| 3,735,546 | 5/1973 | Newman | 52/749 |
| 3,757,484 | 9/1973 | Williamson et al. | 52/749 |
| 3,888,062 | 6/1975 | Gregord et al. | 52/749 |

*Primary Examiner*—L. J. Paperner

*Attorney, Agent, or Firm*—Wenderoth, Lind & Ponack

[57] ABSTRACT

An automatic article-laying apparatus is positioned at the terminal end of a horizontally rotatable conveyor. The apparatus comprises a rotatable roller conveyor, a hydraulic drive to horizontally rotate the roller conveyor, a traversing plate, and a reciprocating head. Placed adjacent to the first-mentioned conveyor, the roller conveyor is horizontally rotatable and carries an article holder that projects sidewards, below the plane on which articles are conveyed, so as to contact the side of the previously laid article. Positioned close and parallel to the roller conveyor, the traversing plate pushes an article away from the roller conveyor, at right angles to the direction of conveyor travel and toward the article holder. Extending along the roller conveyor and behind the article holder, the reciprocating head pushes forward the article delivered from the roller conveyor in the direction of conveyor travel. With this apparatus, hexahedral articles can be laid in an exactly geometrical pattern.

5 Claims, 12 Drawing Figures

AUTOMATIC ARTICLE-LAYING APPARATUS

BACKGROUND OF THE INVENTION

This invention relates to an apparatus for regularly laying hexahedral articles in predetermined positions, and more particularly to an automatic article laying apparatus suited for automatically and continuously lining a furnace by geometrically laying hexahedral refractories of different sizes.

With the recent remarkable technological innovation, industrial furnaces have grown larger and more complex. They have introduced more continuous-operation features, and come to be operated under severer conditions. Under such circumstances, many new furnaces are built and many old furnaces relined. The furnaces cannot be constructed without refractory lining that is accomplished in two ways. A traditional method comprises laying refractory bricks in a geometrical pattern. A more modern method, developed to cope with the recent manpower shortage, uses castable refractories. General preference is given to the brick lining because of its higher reliability.

Conventionally, the brick lining work (hereinafter called brick laying) has been done by manually laying refractory bricks, one on another, that have been carried into a furnace in various ways. But this brick laying is a hard muscular labor. With high temperatures and dust, the work environment is unfavorable. In addition, the unstable demand for this work lowers the personnel efficiency. For these reasons, mechanizing and labor-saving measures have been studied. Some attempts have been made for the development of brick laying apparatus. But none of such attempts have been put to practical use. A brick laying machine should be capable of conveying and laying bricks automatically. It has to convey a brick to the laying position in good condition, put it in place smoothly without tumbling or changing its posture, and accomplish automatic brick laying. No perfect machines have been commercialized.

SUMMARY OF THE INVENTION

This invention has solved the aforementioned problems.

An object of this invention is to provide an automatic article-laying apparatus for placing hexahedral articles in an exactly geometrical pattern.

Another object of this invention is to provide an automatic article-laying apparatus that operates rapidly, stops with high accuracy, and greatly reduces the laying time per article.

Still another object of this invention is to provide an automatic article-laying apparatus that can convey articles stably, being furnished with the dual function of laying and conveying.

Yet another object of this invention is to provide an automatic article-laying apparatus equipped with compact transporting and housing means.

For achieving these objects, an automatic article-laying apparatus according to this invention is positioned at the terminal end of a horizontally rotatable conveyor. The apparatus comprises a horizontally rotatable roller conveyor adapted to be placed adjacent to the first-mentioned conveyor and carrying an article holder that projects sidewards, below the plane on which articles are conveyed, so as to contact the side of the previously laid article, a hydraulic drive to horizontally rotate the roller conveyor, a traversing plate that is positioned close and parallel to the roller conveyor and pushes an article away from the roller conveyor, at right angles to the direction of conveyor travel and toward the article holder, and a reciprocating head that extends along the roller conveyor and behind the article holder and pushes forward the article delivered from the roller conveyor in the direction of conveyor travel.

BRIEF DESCRIPTION OF THE DRAWINGS

FIG. 4 shows a condition in which a refractory brick has been conveyed close to its laying position. FIG. 5 shows a condition in which the refractory brick is pushed sideward. FIG. 6 shows a condition in which a rotatable roller conveyor is withdrawn. FIG. 7 shows a condition in which the refractory brick is pushed forward into position.

DETAILED DESCRIPTION OF THE PREFERRED EMBODIMENT

An automatic article-laying apparatus of this invention is suited for use in laying hexahedral articles, especially refractory bricks, in an exactly geometrical pattern. Now details of this invention will be described by reference to a lining unit for basic oxygen furnaces.

Figure 1:
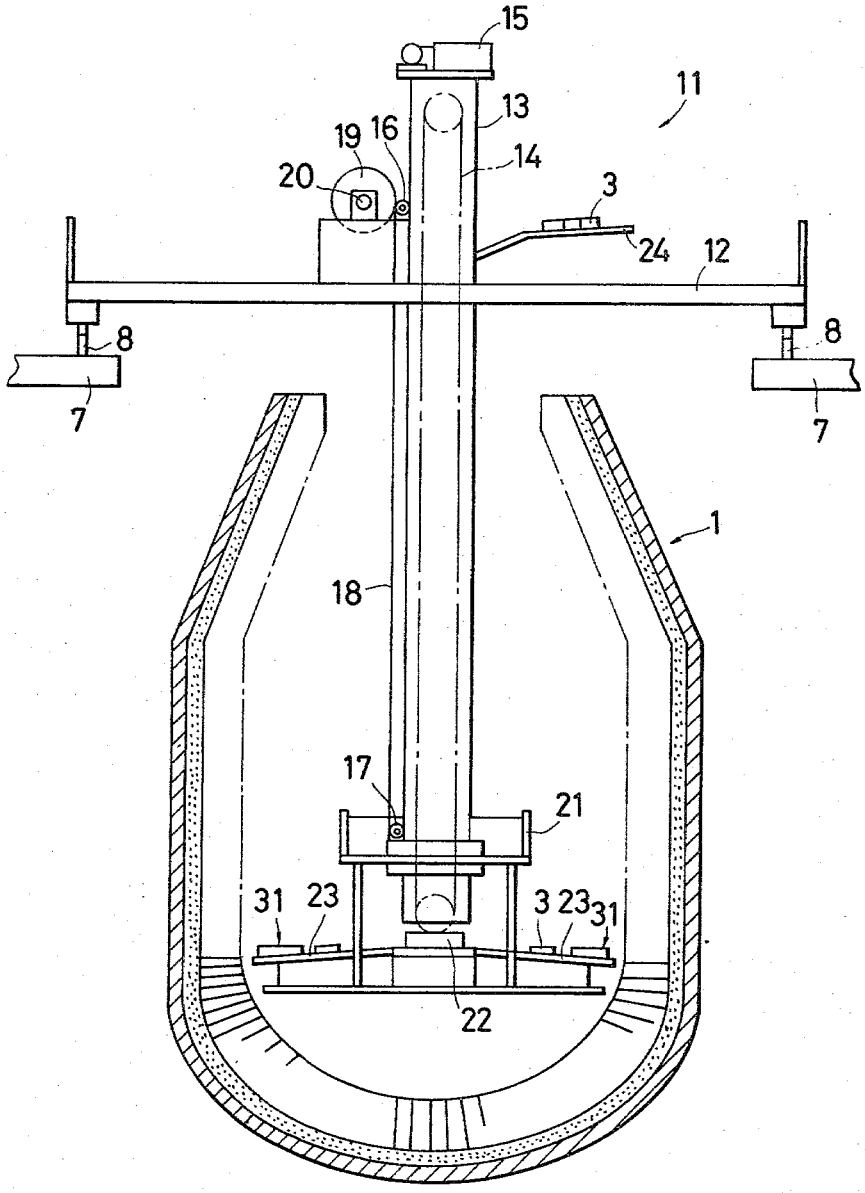
FIG. 1 is a schematic sectional side elevation showing a furnace lining unit equipped with an automatic article-laying apparatus that embodies the principle of this invention, together with the cross-section of a basic oxygen furnace.

As shown in FIG. 1, a furnace lining unit 11 has a tower buggy 12 that runs on rails 8 fixed on the floor 8 and can be positioned right above a basic oxygen furnace 1. The tower buggy 12 carries a tower 13 that moves up and down and contains a vertical conveyor 14 operated by drive means 15. A wire 18 whose end is fixed to a wire drum 19 is slung over a pulley 16 on the tower buggy 12 and a pulley 17 on the tower 13. Rotated by a motor 20, the wire drum 19 either takes up or pays off the wire 18, thereby raising or lowering the tower 13. A rotating carriage 21, rotatably fitted to the bottom of the tower 13, carries a distributor 22. An expandable conveyor 23 extends from the distributor 22.

The rotary carriage 21 of the above-described furnace lining unit 11 is put in the furnace 1. By moving the tower 13, the rotating carriage 21 is positioned at a height where brick is to be lined. On the tower buggy 12, refractory bricks 3 are transferred, one at a time, from a feeder 24 to the vertical conveyor 14, which carries the bricks down to the distributor 22. Thence, the brick 3 is carried to the remotest end of the expandable conveyor 23, where an automatic laying apparatus 31 of this invention receives it for laying in position.

Figure 2:
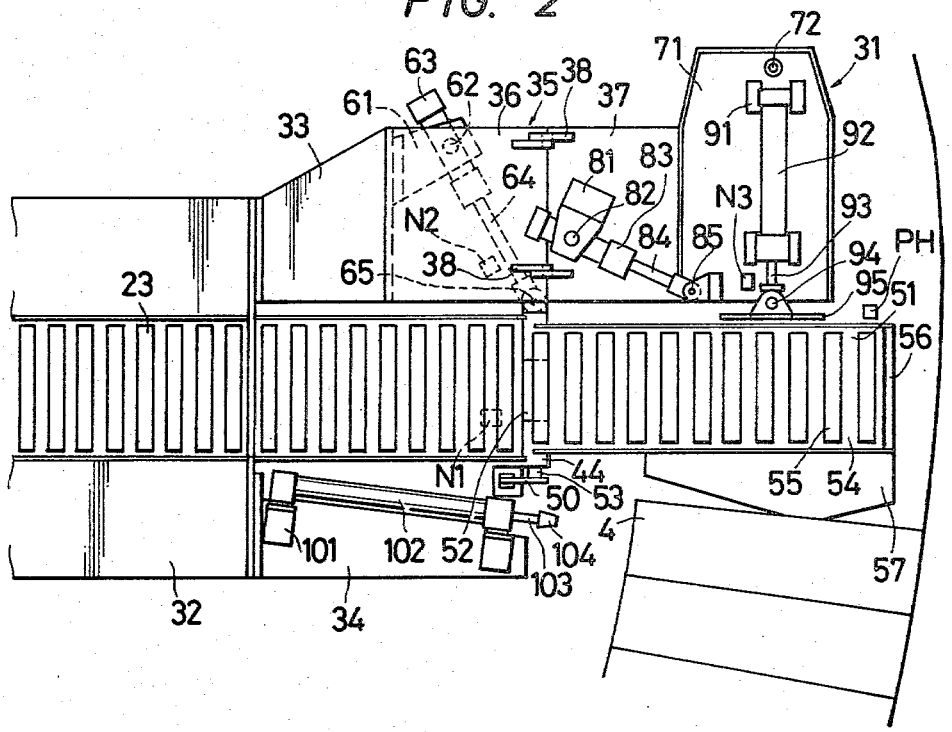
FIG. 2 is a plan view of the automatic article-laying apparatus according to this invention.
Figure 3:
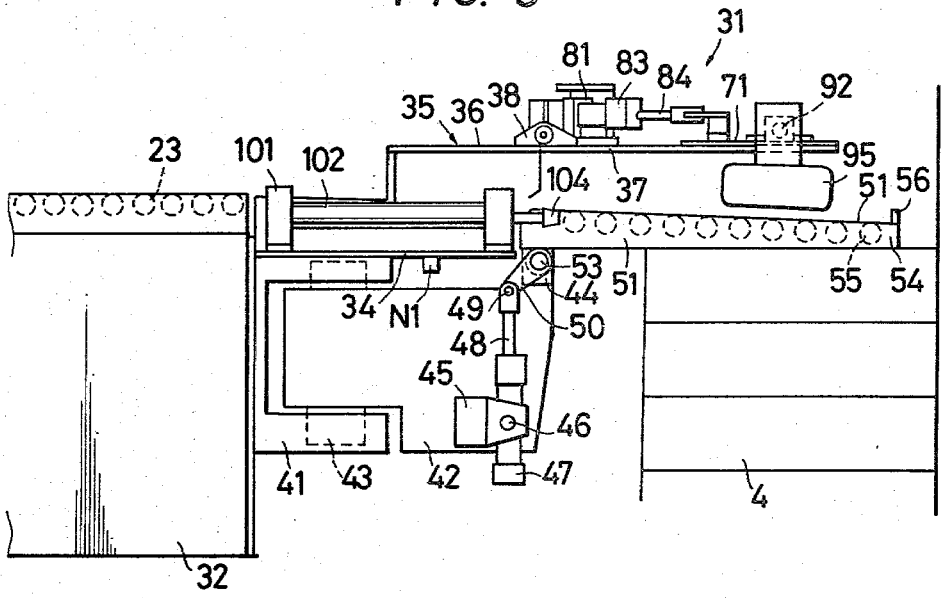
FIG. 3 is a side elevation of the apparatus shown in FIG. 2.

Now the automatic laying apparatus according to this invention will be described by reference to FIGS. 2 and 3.

A stand 32 is placed under the expandable conveyor 23. A left bracket 33 and a right bracket 34 (looking in the downstream of brick travel) project forward from near the front top end of the stand 32. The front end of the left bracket 33 fixes to a base 35 that comprises base plates 36 and 37. The base plates 36 and 37 are joined together by a metal hinge 38, so that the base plate 37 can be manually turned upward, with respect to the base plate 36, from horizontal to vertical. A bearing member 41 fixedly projects forward from the front end of the stand 32. The bearing member 41 supports a rotating shaft 43 fixed to a rotating bracket 42.

A rotatable roller conveyor 51 lies before the front end of the expandable conveyor 23. A shaft 53 fixes through a coupling member 52 to the rear end of the rotatable roller conveyor 51. The shaft 53 is rotatably supported by a bearing 44 fixed on the top of the front end of the rotating bracket 42. A hydraulic cylinder 47 is reciprocatably fitted through a trunnion 46 to a support 45 on the rotating bracket 42. The upper end of a rod 48 of the hydraulic cylinder 47 connects through a pin 49 to one end of an arm 50 so that both can rotate freely. The other end of the arm 50 fixes to the shaft 53. Accordingly, the rotatable roller conveyor 51 turns up and down with the motion of the hydraulic cylinder 47, so that the conveyor 51 can be turned downward until it stands perpendicular to the expandable conveyor 23.

The rotatable roller conveyor 51 comprises a frame 54 and a number of rollers 55 rotatably set therein. The rollers 55 are so arranged as to form a plane that dips forward slightly. Therefore, the refractory brick 3 moves forward by gravity. A stopper 56 is provided at the front end of the rotatable roller conveyor 51. An article holder 57 projects rightward from near the front end, at the same level or slightly below the plane of the rollers 55.

A hydraulic cylinder 64 is reciprocatably fitted through a trunnion 62 to a support 61 on the front end of the left bracket 33. The remotest end of a rod 64 of the hydraulic cylinder 63 connects through a pin 65 to the rotating bracket 42. Therefore, the reciprocation of the hydraulic cylinder 63 turns the rotatable roller conveyor 51 from side to side, integrally with the rotating bracket 42.

A slide plate 71 is placed on the front part of the foremost base plate 37 of the base 35, with a pin 72 fastening them together. A hydraulic cylinder 83 is reciprocatably fitted through a trunnion 82 to a support 81 on the base plate 37. The remotest end of a rod 84 of the hydraulic cylinder 83 connects through a pin 85 to the end of the slide plate 71 opposite to the pin 72. Therefore, the reciprocation of the hydraulic cylinder 83 turns the slide plate 71 about the pin 72. The slide plate 71 carries a hydraulic cylinder 92, extending perpendicular to the direction of conveyor travel, on a support 91. The remotest end of a rod 93 of the hydraulic cylinder 92 connects through a pin 94 to a traversing plate 95.

The right bracket 34 carries a hydraulic cylinder 102, which projects forward, on a support 101. The remotest end of a rod 103 of the hydraulic cylinder 102 connects to a reciprocating head 104.

Next, the operation of the above-described automatic article-laying apparatus will be described by reference to FIGS. 4 through 7.

Figure 4:
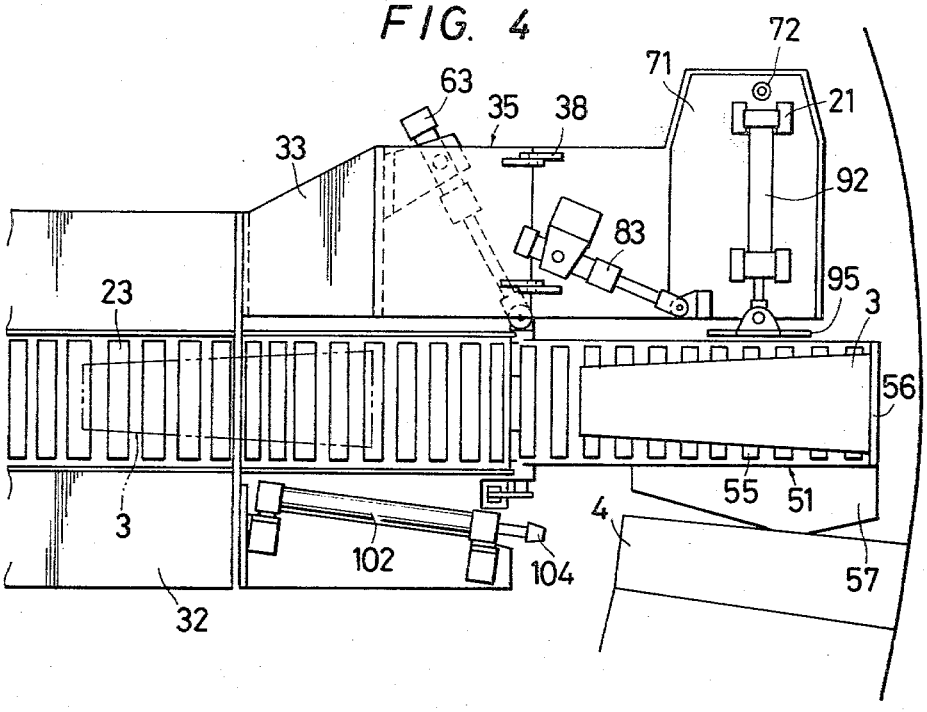
FIGS. 4 through 7 are plan views illustrating the operation of the apparatus.
Figure 5:
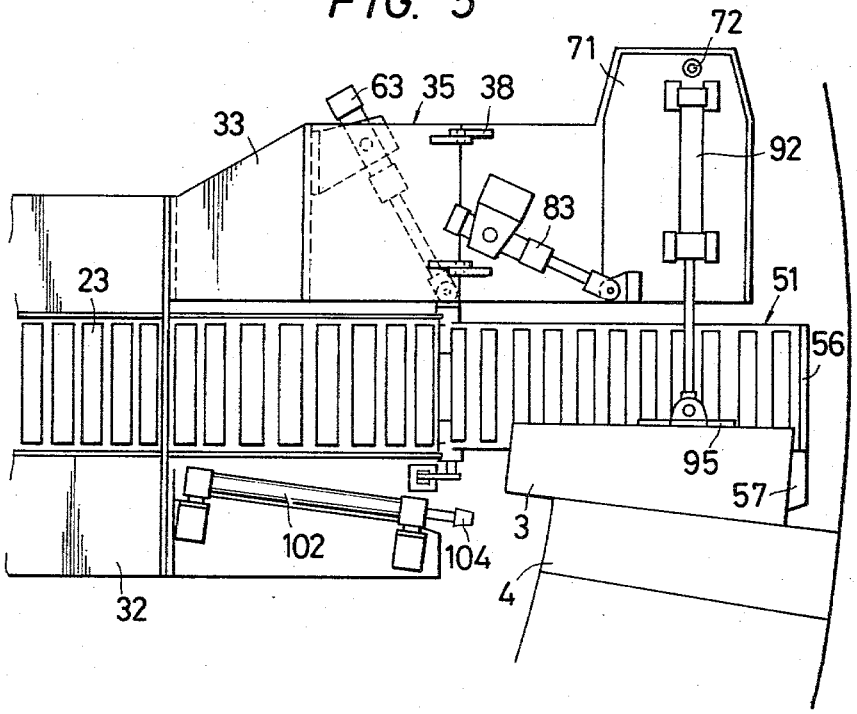

As shown in FIG. 4, the brick 3, carried by the expandable conveyor 23 onto the rotatable roller conveyor 51, stops at the stopper 56. Driven by the hydraulic cylinder 92, the traversing plate 95 pushes the brick 3 rightward until it comes in contact with the previously laid brick 4. Then, as shown in FIG. 5, the brick 3 is held between the traversing plate 95 extended over the rotatable roller conveyor 57 and the previously laid brick 4.

Figure 6:
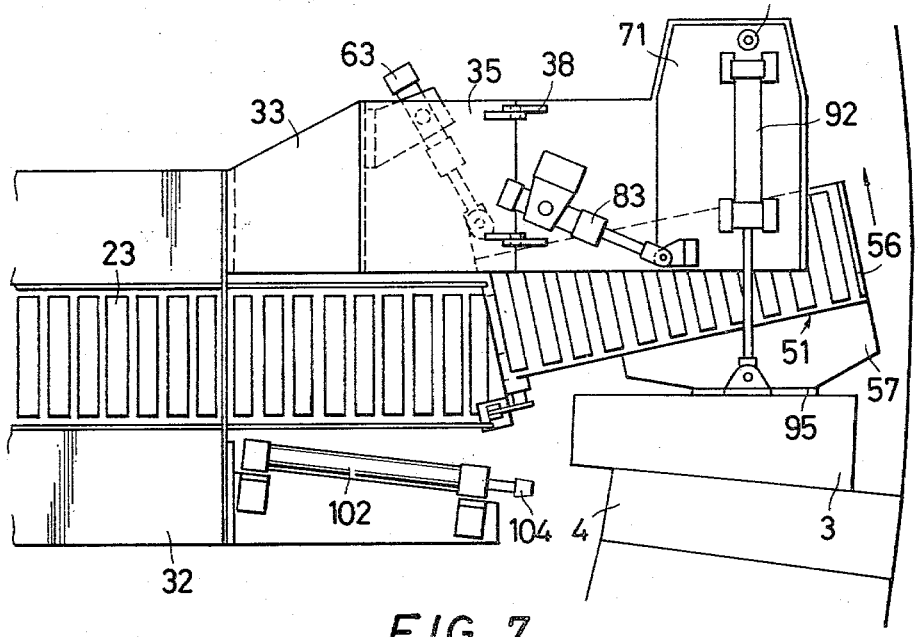
Figure 7:
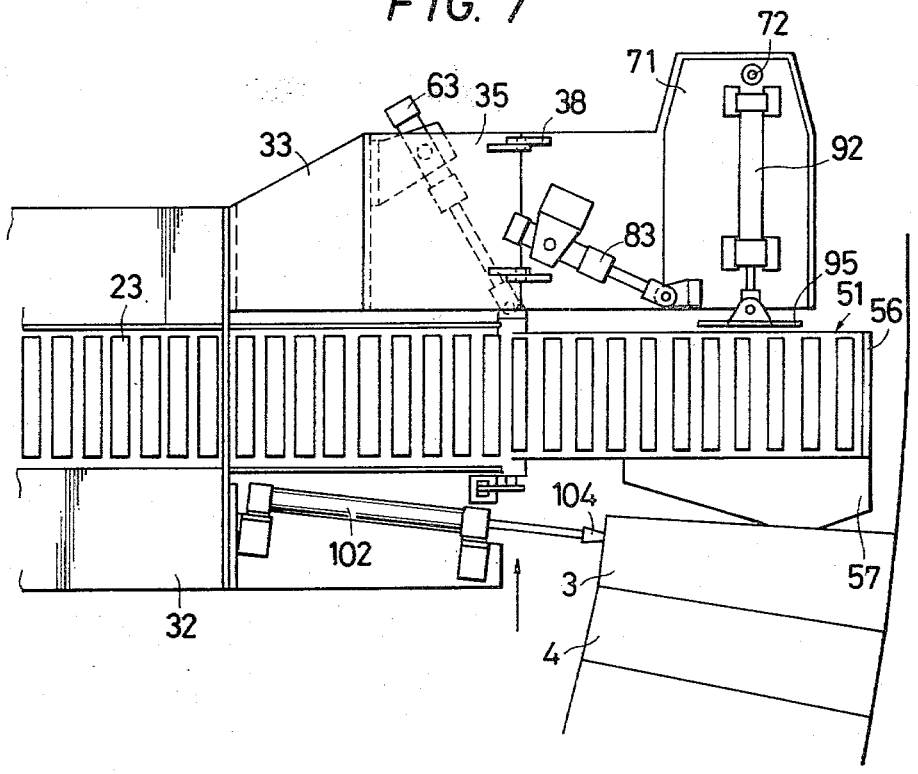

Then, as seen in FIG. 6, the hydraulic cylinder 63 is operated to move the rotatable roller conveyor 51 leftward or opposite to the direction in which the brick 3 is pressed. At the same time, the pressing force is released so that the brick 3 drops by gravity to the level one course below. When the brick 3 has been thus placed in position, the rod 64 of the hydraulic cylinder 63 extends to bring the article holder 57 on the rotatable roller conveyor 51 in contact with the side of the brick 3, so that the sides of the bricks 3 and 4 stick fast to each other. On further extending the rod 64, the expandable conveyor 23, which projects from the rotating carriage 21 so as to be rotatable about the tower 13, shifts its position by the width of the brick 3, or from the position in FIG. 6 to that in FIG. 7. Finally, the hydraulic cylinder 102 pushes forward the reciprocating head 104 to press the brick 3 into position, as shown in FIG. 7. During this final process, the article holder 57 presses the brick 3 against the previously laid brick 4, thereby permitting clearance-free, tight laying.

Next, automatic control of this automatic article-laying apparatus will be described.

Figure 8:
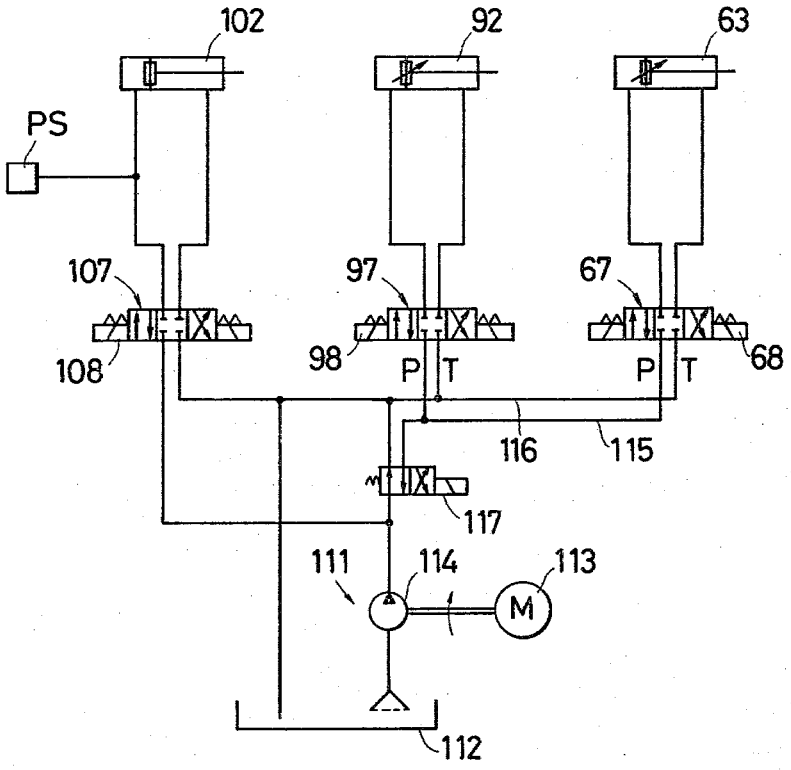
FIG. 8 shows a hydraulic circuit of drive means used in the apparatus of this invention.

FIG. 8 is a circuit diagram of hydraulic drive means containing said hydraulic cylinders. A hydraulic supply 111 comprises an oil tank 112 and a pump 114 driven by a motor 113. The hydraulic cylinder 63 to rotate the rotatable roller conveyor 51, the one 92 to push the brick sideward, and the one 102 to push the brick forward connect to solenoid valves 67, 97 and 107, respectively. These cylinders are of the double-acting type. A hydraulic fluid is supplied from the pump 114 through the solenoid valves to either the piston side or the rod side of the hydraulic cylinders and returned to the oil tank 112 from either the piston side or the rod side thereof, depending on the direction of operation of each cylinder.

A solenoid valve 117 is provided between a line 115 connecting to P-ports of the solenoid valves 67 and 97 and a line 116 connecting to T-ports thereof.

When stopping the automatic article-laying apparatus, the solenoid valve 117 is switched to return the hydraulic fluid from the pump 114 to the tank 112 so that no hydraulic pressure works on the solenoid valves 67 and 97.

Figure 9:
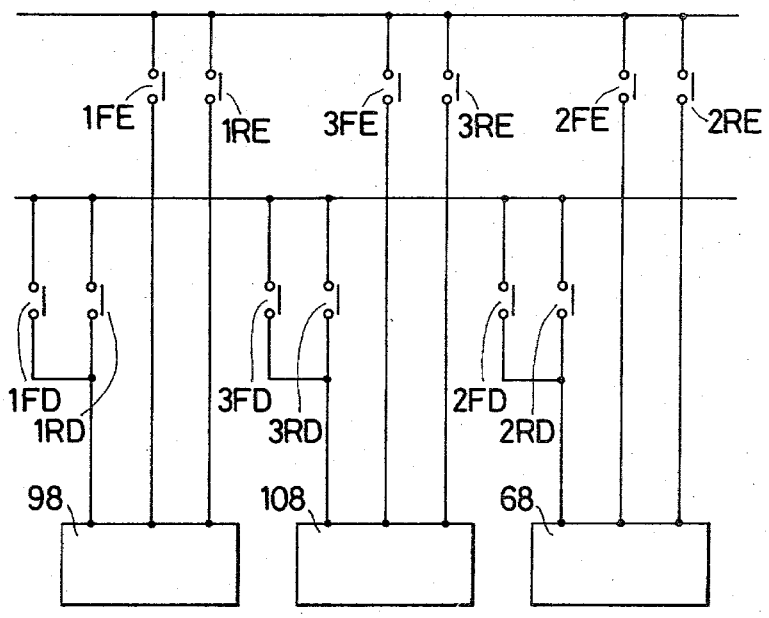
FIG. 9 is a wiring diagram showing the connection between solenoids of solenoid valves and contacts of electromagnetic relays shown in the aforementioned hydraulic circuit.

As shown in FIG. 9, solenoids 68, 98 and 108 of the solenoid valves 67, 97 and 107 connect to contacts 2FD, 2FE, 2RD and 2RE of relays 2F and 2R, contacts 1FD, 1FE, 1RD and 1RE of relays 1F and 1R, and contacts 3FD, 3FE, 3RD and 3RE of relays 3F and 3R, respectively. Each relay will be found in FIG. 11 described later.

Figure 10:
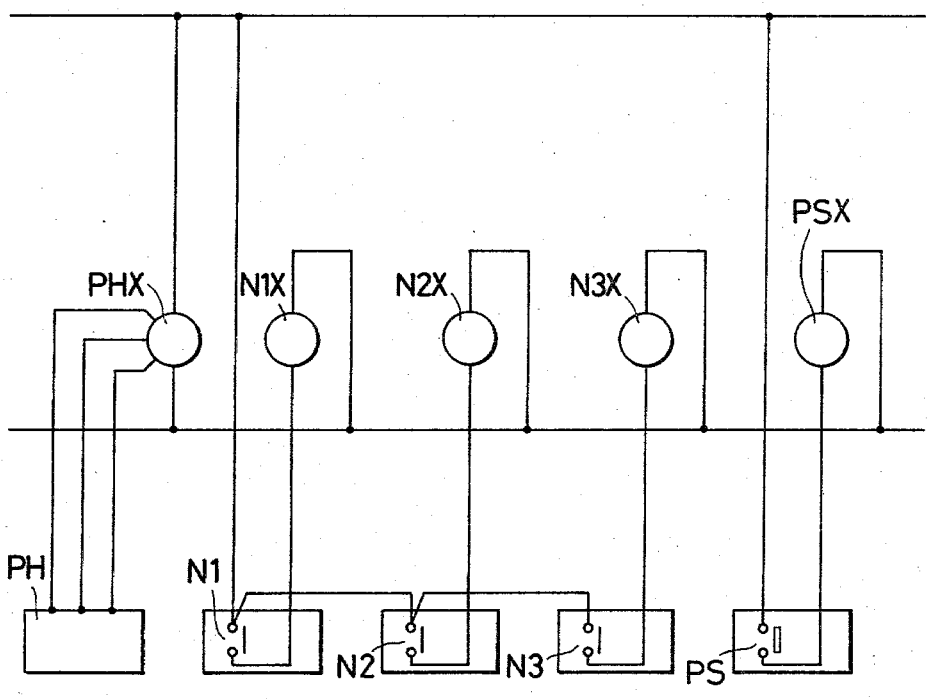
FIG. 10 is a wiring diagram showing the connection between proximity switches and coils of electromagnetic relays used in the drive means.

FIG. 10 is a circuit diagram of proximity switches for detecting operating positions. A relay PHX connects to a photoelectric switch PH (see FIG. 2) that is fitted close to the front end of the rotatable roller onveyor 51 to detect the arrival of the brick 3. A relay N2X connects to a proximity switch N2 that is fitted to the base 35, adjacent to the hydraulic cylinder rod 63, to detect the limit position of the rotatable roller conveyor 51 that has withdrawn (or turned to the left in FIG. 2). A relay N1X connects to a proximity switch N1 that is fitted to the expandable conveyor 23, adjacent to the rotating bracket 42, to detect the limit position of the rotatable roller conveyor 51 that has advanced to cause the article holder 57 to press the side of the brick 3. A relay N3X connects to a proximity switch N3 that is fitted to the slide plate 71, adjacent to the hydraulic cylinder 93, to detect a condition in which the hydraulic cylinder 92 has brought the brick 3 in contact with the previously laid brick 4. A relay PSX connects to a pressure switch PS that is connected to the hydraulic cylinder 102, as shown in FIG. 8, to detect a condition in which the brick 3 has been pushed to the longitudinal limit.

Figure 11:
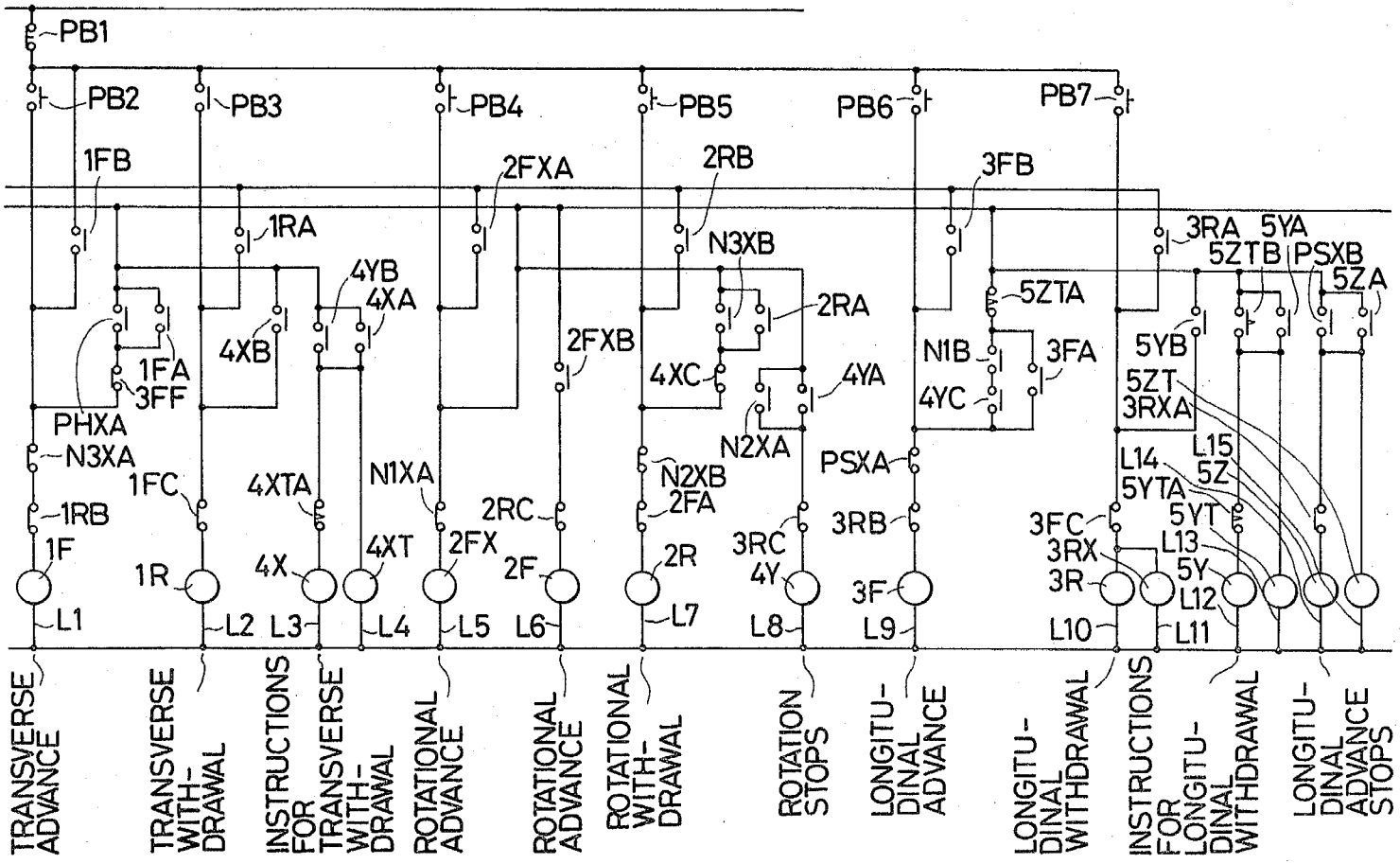
FIG. 11 shows a sequence circuit used for the automatic operation of the apparatus.
Figure 12:
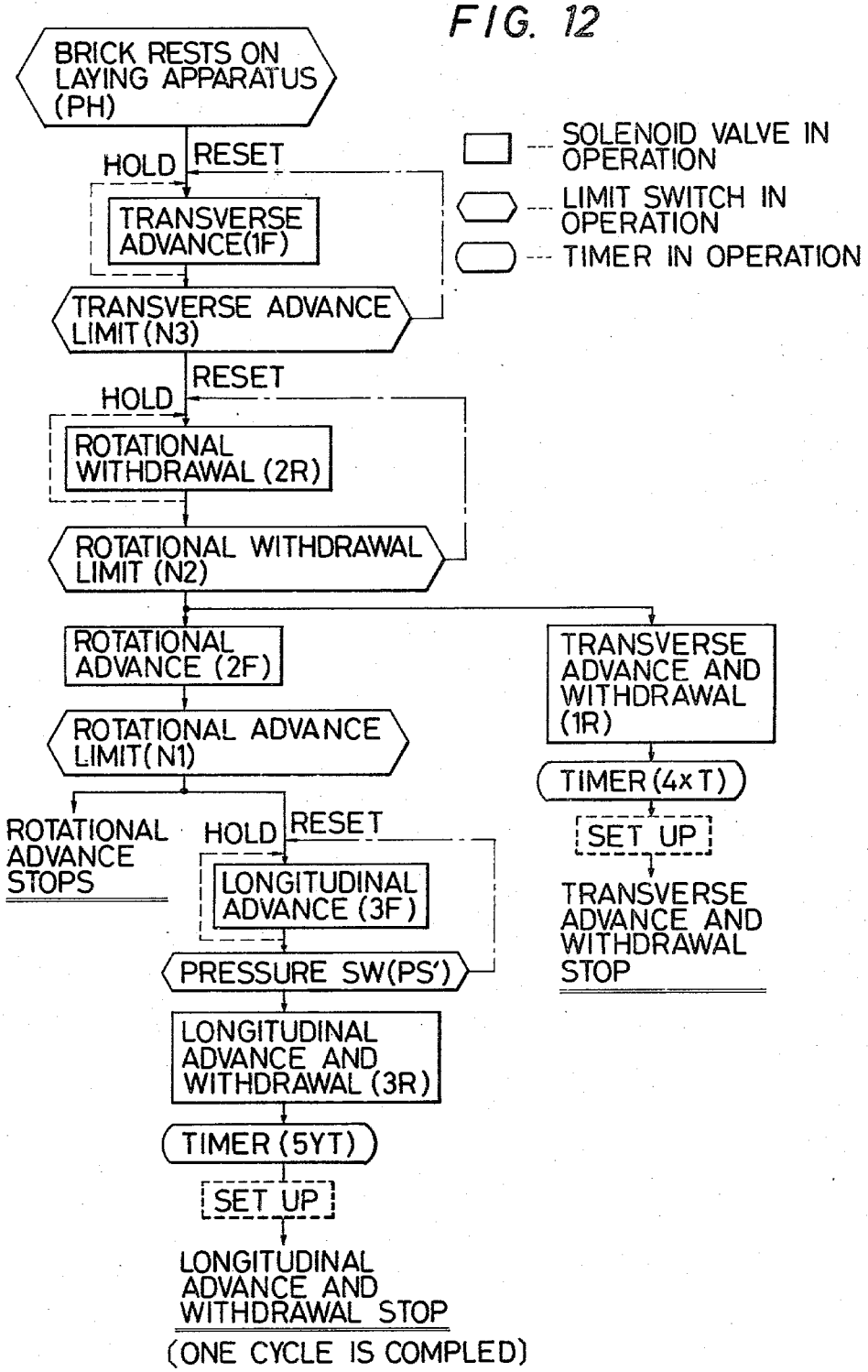
FIG. 12 is a flow chart of the automatic operation.

Now, automatic operation of this apparatus will be described by reference to a sequence circuit in FIG. 11 and a flow chart in FIG. 12. A manual switch PB1 in FIG. 11 stops the apparatus. Manual switches PB2 and PB3 permit moving the brick sideward. Manual switches PB4 and PB5 permit turning the rotatable roller conveyor 51. Manual switches PB6 and PB7 permit pushing the brick longitudinally.

When the photoelectric switch PH detects the arrival of the brick 3, a contact PHXA of the relay PHX closes, whereupon the relay 1F acts to close contacts 1FA and 1FB of a line L1, together with the contacts 1FD and 1FE in FIG. 9. At this time, a contact 1FC of a line L2 opens. This energizes the solenoid 98 in FIG. 8 to actuate the solenoid valve 97, whereupon the hydraulic cylinder 97 operates to push the brick 3 sideward.

When the brick 3 has been pushed sideward as shown in FIG. 5, the proximity switch N3 detects it, whereupon the relay N3X operates to open a contact N3XA of the line L1 and closes a contact N3XB of a line L7. Then, the relay 2R of the line L7 operates to close contacts 2RA and 2RB, open a contact 2RC of a line 6, and close the contacts 2RD and 2RE in FIG. 9. Then, the solenoid 68 becomes energized to actuate the solenoid valve 67. This drives the hydraulic cylinder 63 to withdrawn the rotatable roller conveyor 51, so that the brick 3 drops by gravity to the level one course below. On resetting the traversing circuit, the contacts 1FA, 1FB, 1FD and 1FE open and the contact 1FC closes.

When the rotatable roller conveyor 51 has withdrawn to the position shown in FIG. 6, the proximity switch N2 detects it, whereupon the relay N2X operates to close a contact N2XA of a line L8. Then, a relay 4Y operates to close a contact 4YA of the line L8. At the same time, a contact N2XB of the line L7 opens, and a contact 4YB of a line L3 and a contact 2RC of the line L6 close, thereby resetting the withdrawal circuit for the rotatable roller conveyor 51. A relay 2FX of a line L5 operates to close a contact 2FXA of the line L5 and a contact 2FXB of the line L6, thereby actuating the relay 2F. Then, the contacts 2FD and 2FE in FIG. 9 close, whereby the solenoid 68 becomes energized to actuate the solenoid valve 67. Consequently, the hydraulic cylinder 63 drives the traversing plate 57 so that the brick 3 is pressed against the side of the previously laid brick. Then, the expandable conveyor 23 moves by the width of the brick 3 into the position shown in FIG. 7. At the same time, the contact 4YB of the line L3 closes. Then, a time relay 4XT of a line L4 operates, together with a relay 4X of the line L3, thereby closing a contact 4XA of the line L4 and a contact 4XB of the line L2 and opening a contact 4XC of the line L7. The relay 1R operates to close a contact 1RA and open a contact 1RB of the line L1. Then, the contacts 1RD and 1RE in FIG. 9 become closed and the contacts 1FD and 1FE opened. Consequently, the hydraulic cylinder 92 is driven until a contact 4XTA of the time relay 4XT opens, whereupon the rod 93 withdraws to its original position.

When the expandable conveyor 23 has turned to the position shown in FIG. 7, the proximity switch N1 detects it and the relay N1X operates to open a contact N1XA of a line L5. This, in turn, opens the contacts 2FXA and 2FXB and closes the contact 2FA, thus stopping the rotation of the expandable conveyor 23 by the hydraulic cylinder 63. At the same time, a contact N1B of a line L9 closes, and the relay 3F of the line L9 operates to close contacts 3FA and 3FB of the line L9. A contact 4YC of the line L9 has been closed by the aforesaid operation of the relay 4Y of the line L8. A contact 3FF of the line L1 and a contact 3FC of a line 10 open. Then, the contacts 3FD and 3FE in FIG. 9 close, whereupon the solenoid 108 becomes energized to actuate the solenoid valve 107. This drives the hydraulic cylinder 102 to push the brick 3 longitudinally.

When the brick 3 comes to a standstill in position, the pressure in the hydraulic cylinder 102 rises to actuate the pressure switch PS, which in turn actuates the relay PSX in FIG. 10. THis opens a contact PSXA of the line L9, closes a contact PSXB of a line 14, and actuates a relay 5Z to close a contact 5ZA of a line L15. Then, a time relay 5ZT operates to open a contact 5ZTA of the line L9 and close a contact 5ZTB of a line L12 after a predetermined time has elapsed. Consequently, the contacts 3FD and 3FE in FIG. 9 open to stop the operation of the hydraulic cylinder 102 and reset the circuit for the longitudinal push. When the contact 5ZTB closes as described above, a relay 5Y of the line L12 operates to close a contact 5YA of a line L13 and a contact 5YB of the line L10, whereupon a time relay 5YT of the line L13 operates. Until a contact 5YTA of the time relay 5YT opens, the relay 3R of the line L10 and a relay 3RX of a line L11 operate to close a contact 3RA of the line L10 and open a contact 3RB of the line L9 and a contact 3RXa of the line L14. Then, the contacts 3FD and 3FE in FIG. 9 open and the contacts 3RD and 3RE close, whereby the solenoid 108 becomes energized to actuate the solenoid valve 107. Consequently, the rod 103 of the hydraulic cylinder 102 returns to the original position while the contact 5YTA remains closed. At this time, a contact 3RC of the line L8 opens.

The brick laying cycle according to this invention ends when the brick has been pushed longitudinally, thus permitting a smooth transition to the laying of the next brick. This feature facilitates a continuous, automatic laying operation. Particularly effective is a design that permits stably pushing sideward bricks of different sizes. This design consists in traversing means that pushes the brick in the vicinity of its center of gravity. The embodiment described is adapted to achieve good results by turning the slide plate 71 about the pin 72 by the hydraulic cylinder 83 so that the traversing plate 95 be adjusted to the center of gravity of the brick.

The hinged rotatable roller conveyor 51 and the base 37 carrying the hydraulic cylinders 83 and 92 facilitate the housing of the apparatus.

Although this specification has described an application to brick laying, the apparatus of this invention can be used also for placing boxes or box-like articles in position.

Hydraulic cylinders are used for the traversing means, rotating means, reciprocating means, transverse positioning means and collapsing means of the above-described embodiment. But other driving means with similar functions can be used, too.

As will be understood, fromt he above, this invention enables bricks and other articles to be placed in position in a very short time. It permits automatic brick laying with quick operation, high stop accuracy and stable brick transfer. In addition, the apparatus of this invention is compact enogugh to facilitate its transportation and housing.

What is claimed is:

1. An automatic article-laying apparatus, which is adapted to be positioned next to the terminal end of a horizontally rotatable conveyor and comprises:

horizontally rotatable conveying means adapted to be positioned next to said conveyor, said conveying means carrying article holding means that projects sideward, below the plane on which an article is conveyed, so as to contact the side of the previously laid article;

driving means for horizontally rotating said rotatable conveying means;

means for pushing the article transversely, positioned close and parallel to said rotatable conveying means, said transverse pushing means being adapted to push the article away from said rotatable conveying means, at right angles to the traveling direction thereof and toward said article holding means; and means for pushing the article longitudinally, positioned behind said article holding means and along said rotatable conveying means, said longitudinal pushing means being adapted to push the article, delivered from said rotatable conveying means, in the traveling direction thereof.

2. An automatic article-laying apparatus according to claim 1, wherein:

the rear end of said rotatable conveying means is fitted to a rotating bracket that is vertically rotatably fitted to a stand placed under said conveyor;

said horizontally rotating means comprises a hydraulic cylinder reciprocatably fitted to a first fixed bracket on said stand, the remotest end of a rod of said hydraulic cylinder connecting to the rear end of said rotatable conveying means;

said transverse pushing means comprises a hydraulic cylinder mounted on a base fitted to said fixed bracket; and said longitudinal pushing means comprises a hydraulic cylinder fitted to a second fixed bracket on said stand.

3. An automatic article-laying apparatus according to claim 2, wherein:

said base comprises two base plates that are hinged together so that the front base plate can be turned with respect to the rear base plate.

4. An automatic article-laying apparatus according to claim 2, which comprises:

means for adjusting the transverse pushing position, said adjusting means comprising a slide plate, mounted on said base so as to be rotatable about a vertical shaft and carrying the hydraulic cylinder for transverse pushing, and a hydraulic cylinder reciprocatably fitted to said base, the remotest end of a rod of said hydraulic cylinder connecting to said slide plate.

5. An automatic article-laying apparatus according to claim 2, which comprises:

means for collapsing said rotatable conveying means, said collapsing means comprising a hydraulic cylinder reciprocatably fitted to said rotating bracket and an arm connecting the remotest end of a rod of said hydraulic cylinder and the rear end of said rotatable conveying means, whereby said rotatable conveying means moves up and down with the reciprocation of said hydraulic cylinder.

* * * * *